US007291046B2

(12) United States Patent
Russelburg

(10) Patent No.: US 7,291,046 B2
(45) Date of Patent: Nov. 6, 2007

(54) ELECTRICAL CONTACT ASSEMBLY

(75) Inventor: Kevin L. Russelburg, Lemont, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/389,831

(22) Filed: Mar. 27, 2006

(65) Prior Publication Data

US 2007/0042649 A1 Feb. 22, 2007

Related U.S. Application Data

(60) Provisional application No. 60/710,089, filed on Aug. 22, 2005.

(51) Int. Cl.
*H01R 11/22* (2006.01)

(52) U.S. Cl. ..... 439/857

(58) Field of Classification Search ..... 439/857, 439/856, 887, 852, 439
See application file for complete search history.

(56) References Cited

U.S. PATENT DOCUMENTS

| | | | | |
|---|---|---|---|---|
| 2,813,257 | A * | 11/1957 | Cornell, Jr. | 439/847 |
| 3,828,706 | A * | 8/1974 | Scott | 29/879 |
| 5,833,500 | A * | 11/1998 | Mahon et al. | 439/852 |
| 6,402,571 | B1 * | 6/2002 | Muller et al. | 439/745 |
| 6,971,905 | B2 * | 12/2005 | Makita et al. | 439/447 |
| 7,004,797 | B2 * | 2/2006 | Harada et al. | 439/857 |
| 2006/0121797 | A1 * | 6/2006 | Casses et al. | 439/851 |

* cited by examiner

*Primary Examiner*—Phuong Dinh
(74) *Attorney, Agent, or Firm*—Mark W. Croll; Paul F. Donovan

(57) ABSTRACT

Embodiments of the present invention provide an electrical contact assembly that includes a main body, contact legs, and an interlocking member. The main body is configured to receive and retain a wire. The contact legs are configured to mate with a mating structure, and the interlocking member limits spreading of the contact legs.

11 Claims, 3 Drawing Sheets

ELECTRICAL CONTACT ASSEMBLY

RELATED APPLICATIONS

This application relates to and claims priority benefits from U.S. Provisional Patent Application 60/710,089 entitled "Electrical Contact Assembly," filed Aug. 22, 2005, which is hereby incorporated by reference in its entirety.

FIELD OF THE INVENTION

Embodiments of the present invention generally relate to an electrical connector or contact assembly, and more particularly, to an electrical contact assembly including interlocking members that ensure that contact legs remain in an optimal contacting position during assembly and use.

BACKGROUND OF THE INVENTION

Electrical connectors or contacts are used in many, if not all, electrical assemblies or systems. FIGS. 1 and 2 illustrate top and lateral elevational views, respectively, a conventional electrical contact assembly 10. The electrical contact assembly 10 includes a main body 12, a terminal latch 14, and an assist spring 16 secured to, and/or around, contact legs 18.

The main body 12 includes a U-shaped housing 20 that is adapted to receive a wire (not shown). The U-shaped housing 20 is crimped around the wire to secure the wire to the electrical contact assembly 10.

The contact legs 18 and the assist spring 16 are distally located from the main body 12. The contact legs 18 are configured to receive a mating contact (not shown), and the assist spring 16 surrounds the contact legs 18 to provide structural strength and integrity. That is, the assist spring 16 acts to limit outward spreading of the contact legs 18.

When the contact legs 18 receive a mating contact, the contact legs 18 spread apart. The assist spring 16 exerts an inwardly-directed force into the contact legs 18 to assist in maintaining the structural integrity of the contact legs 18 so that the contact legs 18 maintain contact with the mating contact.

The resilient terminal latch 14 snapably or latchably connects to the contact legs 18 and/or the main body 12. The latch 14 moves inward during assembly and returns to its original position once assembled, thereby securing to the main body 12.

As shown in FIGS. 1 and 2, the electrical contact assembly 10 includes three separate and distinct components. That is, the electrical contact assembly 10 includes the main body 12 integrally connected to the contact legs 18, and the separate latch 14 and the separate assist spring 16. The separate and distinct components of the electrical contact assembly add undesirable manufacturing and assembly costs.

Additionally, the contact legs 18 and the assist spring 16 do not always maintain even contact with the mating contact. As the contact legs 18 receive the mating contact, the contact legs 18 are susceptible to separating in such a way that the contact legs 18 do not engage the reciprocal or counterpart mating contacts. Further, the contact legs 18 may separate unevenly and do not always remain parallel to one another during mating. For example, the top portions 22 of the contact legs 18 may spread farther apart than the bottom portions 24 of the contact legs 18 during a mating process, thereby engaging the reciprocal mating contact unevenly. Uneven mating between the contact legs 18 and the reciprocal mating structure may result in arcing, loss of power, and/or poor performance of a system including the electrical contact assembly 10.

Thus, a need exists for a more reliable electrical contact assembly that is cheaper and easier to manufacture and assemble. Further, a need exists for an electrical contact assembly that is configured to safely, securely, and evenly mate with a reciprocal or counterpart mating contact.

SUMMARY OF THE INVENTION

Certain embodiments of the present invention provide an electrical contact assembly that includes a main body, first and second contact legs, first and second resilient beams, and an interlocking member. The main body is configured to receive and retain a wire, such as through crimping. The first and second contact legs are configured to mate with a mating structure, such as a reciprocal or counterpart electrical pin that is configured to be compressively sandwiched between the first and second contact legs.

The first resilient beam is connected to the first contact leg, while the second resilient beam is connected to the second contact leg. The interlocking member may include first and second fingers, wherein the first finger is connected to the first resilient beam, and the second finger is connected to the second resilient beam. Thus, movement of the contact legs causes the first and second fingers to move.

The interlocking member limits spreading of the first and second contact leg and maintains a normal force of the first and second contact legs. For example, the first finger may include a first finger beam integrally formed with a first ridge, and the said second finger may include a second finger beam integrally formed with a second ridge. The first ridge may be separated from the second ridge by a gap when the electrical contact assembly is at rest. When the first and second contact legs begin to spread apart, the first ridge abuts against at least one of the second ridge and the second finger beam, thereby halting movement of the first and second fingers and the first and second contact legs. The fingers may be L-shaped, or C-shaped.

The electrical contact assembly may also include a lance member, or connection beam, integrally connected to the contact legs. The lance member or connection beam may form a connection or bridge between the contact legs.

The first and second contact legs may have a first material temper, which is rigid, while the main body may have a second material temper, which is less rigid than the first material temper. The second material temper may be easier to crimp than the first material temper.

Figure 1:
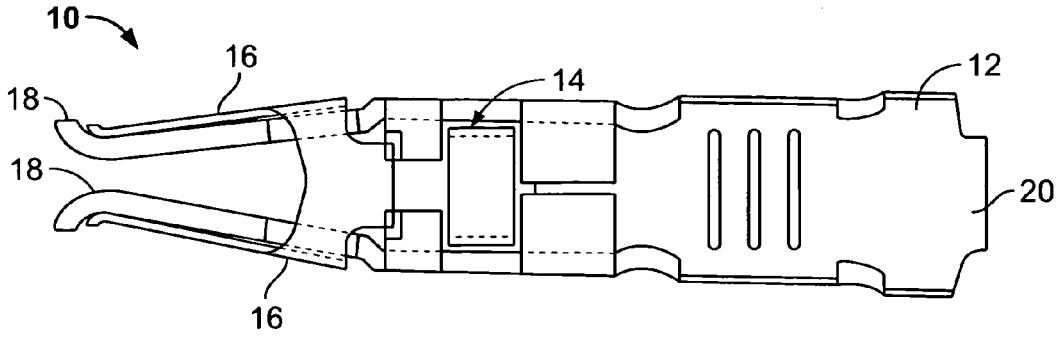
FIG. 1 (Prior Art)
FIG. 1 illustrates a top elevational view of a conventional electrical contact assembly.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

Figure 3:
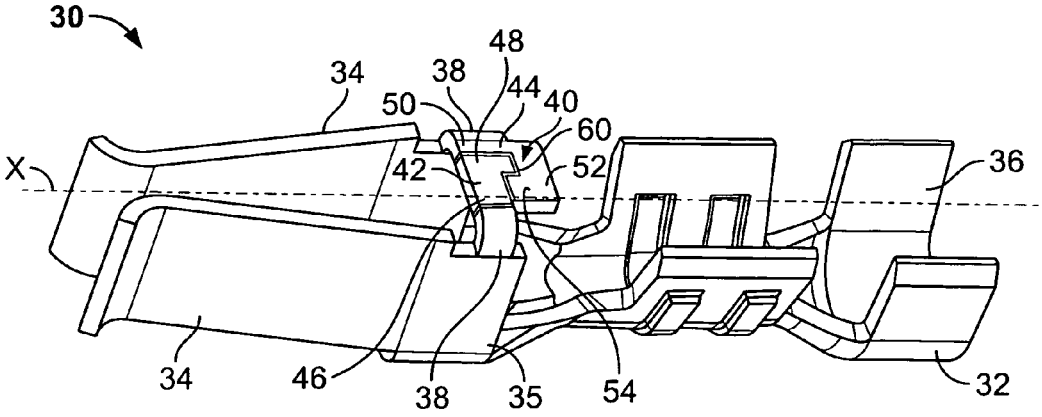
FIG. 3 illustrates a top isometric view of an electrical contact assembly according to an embodiment of the present invention.

FIG. 3 illustrates a top isometric view of an electrical contact assembly 30 according to an embodiment of the present invention. The assembly 30 includes a main body 32 integrally connected to two contact legs 34. The contact legs 34 mirror each other. The main body 32 includes a U-shaped housing 36 configured to be crimped around a wire (not shown).

Each contact leg 34 may be integrally connected to a resilient beam 38. An interlocking member 40 spans from one beam 38 to the other. The interlocking member 40 may be integrally connected to the beams 38. Optionally, each beam 38 may separately join to a portion of the interlocking member 40.

Figure 2:
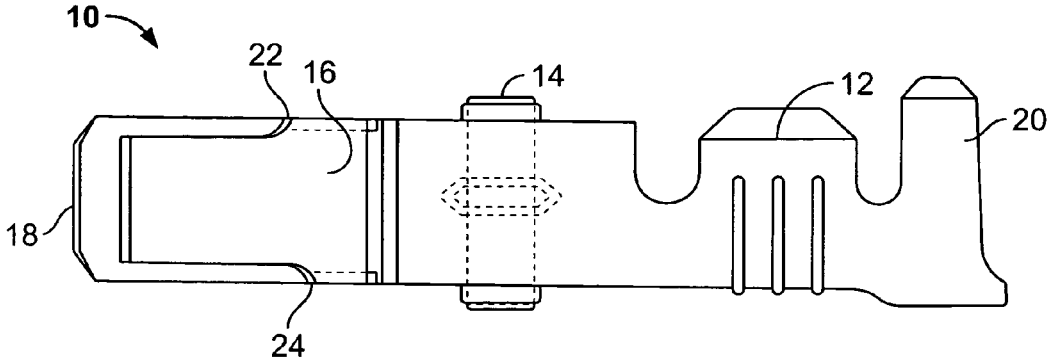
FIG. 2 (Prior Art)
FIG. 2 illustrates a lateral elevational view of a conventional electrical contact assembly.

As shown in FIG. 3, the electrical contact assembly 30 may be a unitary piece. Further, the electrical contact assembly 30 does not include an assist spring, or a resilient terminal latch. Thus, the electrical contact assembly 30 is easier and less expensive to manufacture than the electrical contact assembly 10 (shown in FIGS. 1 and 2), which includes additional separate components.

Figure 4:
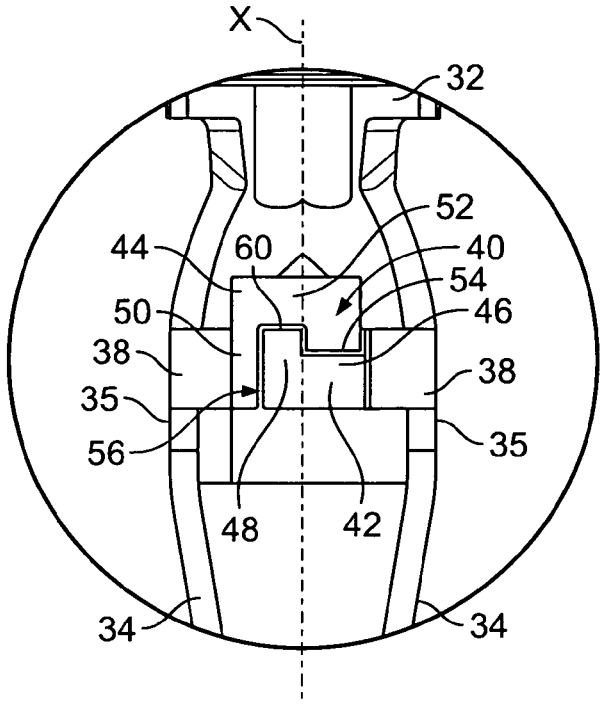
FIG. 4 illustrates a top elevational view of an interlocking member of an electrical contact assembly according to an embodiment of the present invention.

FIG. 4 illustrates a top elevational view of the interlocking member 40. As shown in FIGS. 3 and 4, the interlocking member 40 includes two interlocking fingers 42 and 44. One finger 42 is connected to a resilient beam 38, while the other finger 44 is connected to the opposite resilient beam 38.

The finger 42 includes an extension beam 46 that extends from the beam 38 toward the vertical plane X of the longitudinal axis of the electrical contact assembly 30. A ridge 48 is integrally connected to the extension beam 46 at a right angle and is oriented toward the main body 32. Thus, the finger 42 forms an L-shape.

The finger 44 includes an extension beam 50 that extends toward the main body 32, and is integrally connected to a spanning beam 52 at a right angle. The spanning beam 52 is, in turn, integrally connected to a ridge 54 at a right angle, such that the ridge is directed away from the main body 32. As such, the finger 44 forms a C-shape.

The ridge 48 of the finger 42 is positioned within a cavity 56 formed between the extension beam 50, the spanning beam 52, and the ridge 54 of the finger 44. As such, a distal end of the ridge 48 of the finger 42 is proximate a distal end of the ridge 54 of the finger 44. A gap 60 is formed between the fingers 42 and 44 while the fingers are at rest. That is, the gap 60 is maintained between the fingers 42 and 44 when the electrical contact assembly 30 is not mated with a reciprocal or counterpart mating structure.

While the fingers 42 and 44 are shown having an L-shape and a C-shape, respectively, the shapes may be reversed. For example, the finger 42 may have a C-shape, while the finger 44 has the L-shape. Additionally, while the fingers 42 and 44 are shown having straight line beams that connect at right angles, the fingers 42 may be various other shapes, sizes, and the like that allow for an interlocking configuration at various angles.

When the electrical contact assembly 10 is mated with a reciprocal or counterpart mating structure (not shown), distal ends of the contact legs 34 separate from one another. As the distal end of he contact legs 34 separate, the base portions 35 of the contact legs move inwardly toward one another. Thus, the resilient beams 38 move inwardly toward another causing the ridge 48 of the finger 42 to abut into the extension beam 50 of the finger 44, thereby removing the gap 60 therebetween. The abutting relationship of the ridge 48 of the finger 42 into the extension beam 50 of the finger 44 stops further movement of the fingers 42 and 44, and consequently the inward movement of the beams 38. Because the beams 38 are connected to the contact legs 34, the spreading movement of the contact legs 34 also ceases when the ridge 48 abuts into the extension beam 50.

Alternatively, the electrical contact assembly 30 may be configured so that during the separation of the distal ends of the contact legs 34, the beams 38 move in a corresponding direction and pull on the fingers 42 and 44. As the fingers 42 and 44 follow in the directions of their associated beams 38, the fingers 42 move away from each other. However, as the fingers 42 and 44 begin to separate, the ridge 48 of the finger 42 abuts against the ridge 54 of the finger 44, thereby closing the gap 60 therebetween. The abutting relationship between the ridges 48 and 54 stops further movement of the fingers 42 and 44, and, consequently the beams 38. Because the beams 38 are connected to the contact legs 34, the spreading movement of the contact legs 34 also ceases when the ridges 48 and 54 abut one another.

Whether the beams 38 move in the same direction of the distal ends of the contact legs 34, or in an opposite direction, the interlocking member 40 acts to limit the spreading of the contact legs 34, thereby ensuring that the contact legs 18 remain in positions of optimal contact with a reciprocal or counterpart mating structure. That is, the interlocking member 40 may be configured to stop movement of the contact legs 34 past a point in which optimal contact with a mating structure may be lost.

As detailed above, the locking member 40 controls the movement of the contact legs 34. Because of the controlled movement of the contact legs 34, the interlocking member 40 ensures that the contact legs 34 remain in a parallel relationship with one another such that the electrical contact assembly 30 is symmetrical about the vertical plane X of the longitudinal axis of the assembly 30 in the region around the contact legs 34.

As the mating structure is removed from the contact legs 18, the resilient beams 38 allow the contact legs 34 to move back to their at-rest positions. Similarly, the resilient beams 38 allow the fingers 42 and 44 to return to their at-rest positions, thereby reforming the gap 60 between the fingers 42 and 44.

Figure 5:
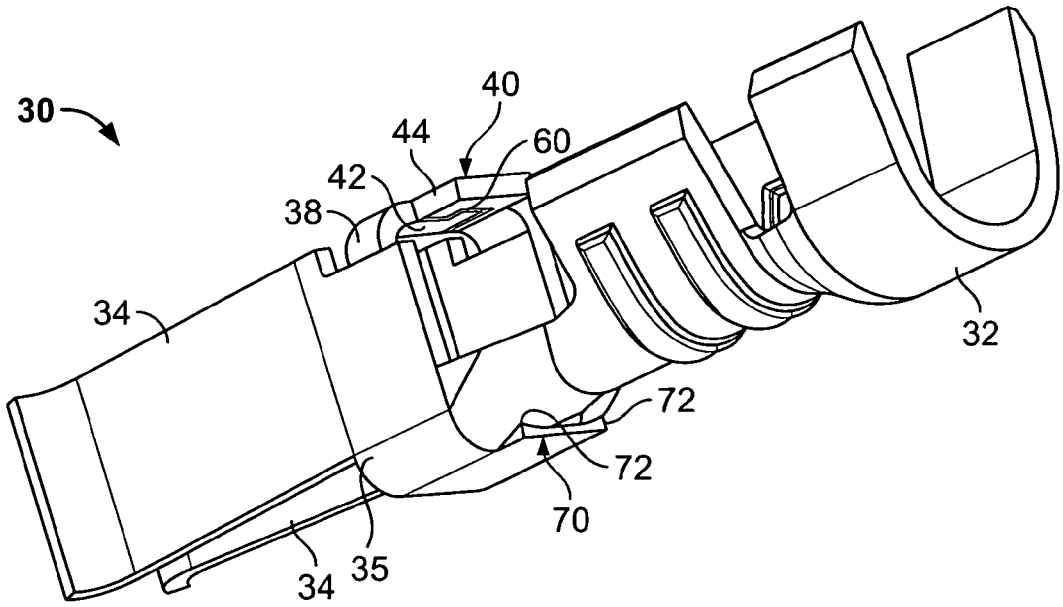
FIG. 5 illustrates a bottom isometric view of an electrical contact assembly according to an embodiment of the present invention.

FIG. 5 illustrates a bottom isometric view of the electrical contact assembly 30. A bottom portion of the assembly 30 includes a lance member 70, or other such connection beam. The lance member 70 is positioned on the opposite side of the assembly 30 from the interlocking member 40. The lance member 70 is an integrated housing retaining member. The lance member 70 may include barbs, clasps, or other such protrusions 72 that act as a barrier with respect to mating contact movement. That is, the protrusions 72 may block movement of the mating contact and ensure that the mating contact is properly positioned within the electrical contact assembly 30.

When the fingers 42 and 44 of the interlocking member move into an interlocking position (such that the a portion of the finger 42 abuts a portion of the finger 44, as discussed above), the lance member 70 may act as an anchor that ensures that the assembly 30 remains together. That is, the lance member 70 is a solid piece of material connected to, or integrally formed between, lower portions of the contact legs 34. As the contact legs 34 separate, the lance member 70 ensures that the contact legs 34 do not break apart from one another.

The interlocking member 40 and the lance member 70 protect against the contact legs 34 opening freely during engagement or mating. Preventing the contact legs 34 from opening freely is advantageous because normal forces or engagement forces remain constant. If the contact legs 34 were allowed to continue opening freely, the normal forces would be reduced significantly. Normal forces are a vital part of a electrical contact assembly and are often specified in product specifications and/or requirements. Normal forces relate to the amount of force required to ensure proper contact with the mating contact. As discussed above, the interlocking member 40 and the lance member 70 (i) ensure that the contact legs 34 remain parallel during assembly and use, (ii) prevent the contact legs 34 from opening beyond a desired amount (i.e., a distance past which optimal engagement with a mating contact is lost), and (iii) maintain the normal forces during assembly. For example, the interlocking member 40 and the lance member 70 ensure that the contact legs 34 are not separated, stretched, or otherwise moved past their elastic limit.

Figure 6:
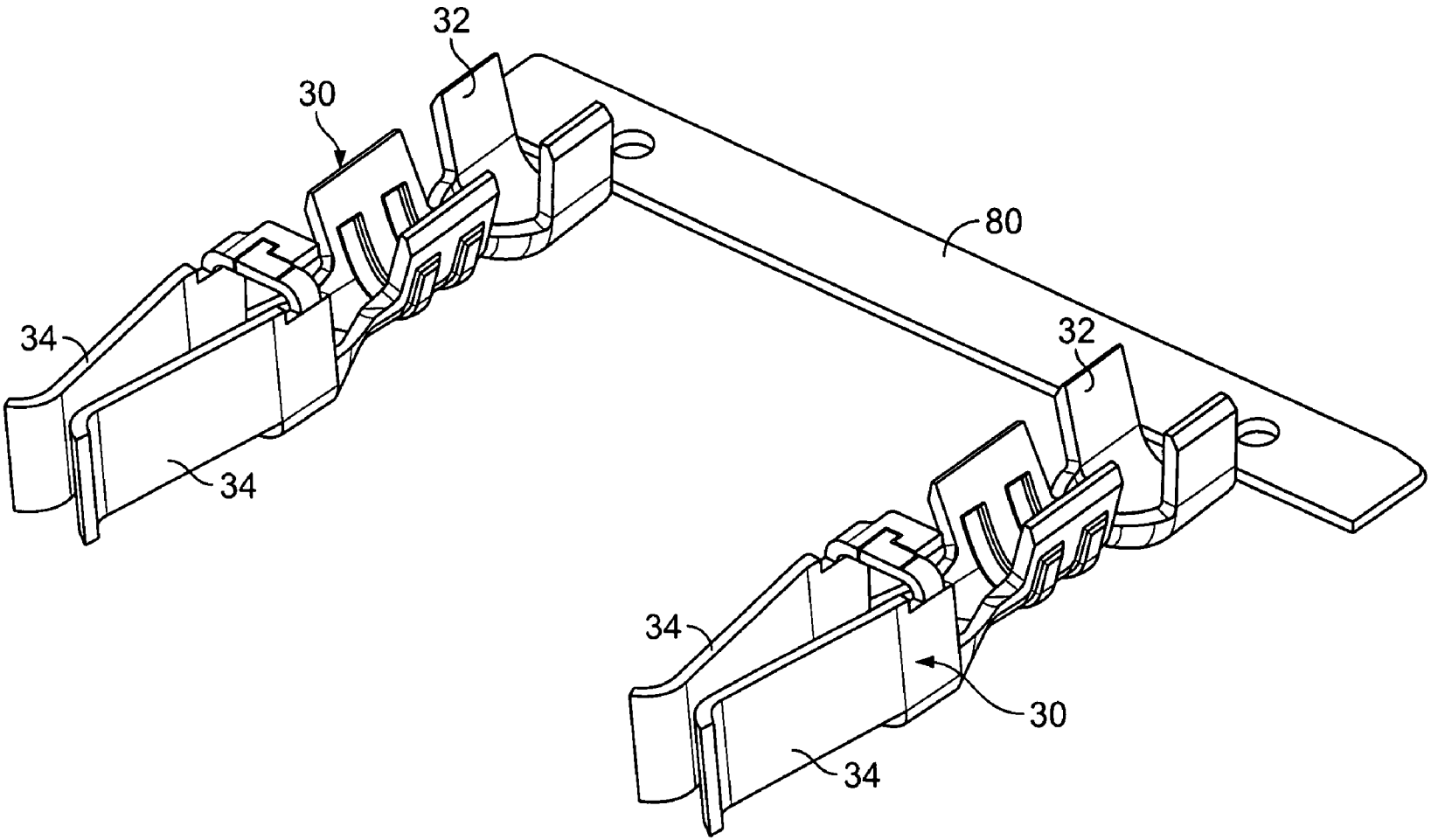
FIG. 6 illustrates a top isometric view of electrical contact assemblies connected to an assembly bar according to an embodiment of the present invention.

FIG. 6 illustrates a top isometric view of electrical contact assemblies 30 connected to an assembly bar 80. The electrical contact assemblies 30 may be manufactured on a stamping press and rolled into a reel. Thereafter, the electrical contact assemblies 30 are plated and shipped. An end user or customer may terminate a wire and insert it into an electrical contact assembly 30.

Each electrical contact assembly 30 may be made from beam-welded material. Beam weld combines two different material tempers to achieve zones of varying strength. A spring temper may be used with respect to, or proximate, the contact legs 34. The spring temper provides the rigidity needed to achieve the desired normal forces. However, this material may be difficult to crimp onto a wire. Thus, the main body 32 (i.e., the crimping portion) may be formed using a half-hard temper, in order to allow for an lesser force for crimping.

While the electrical contact assembly 30 is shown and described above, numerous alternative designs may be used. For example, the contact legs 34 may be bifurcated, such that a slot may be formed between an upper and lower contact. Thus, the bifurcated contact legs may contact a mating contact at four separate points. Additionally, as noted above, the interlocking member 40 may include fingers having C, L, or various other shapes, sizes, surfaces, contours, and the like that provide an interlocking relationship between the fingers. Further, the electrical contact assembly 30 may include more than one interlocking member 40. Also, the lance member 70 may be on the top of the electrical contact assembly 30, while the interlocking member 40 may be on the bottom of the electrical contact assembly 30.

Thus, embodiments of the present invention provide a more reliable electrical contact assembly that is cheaper and easier to manufacture and assemble. That is, because electrical contact assembly 30 includes fewer separate and distinct parts than the electrical contact assembly 10, manufacturing time and costs are decreased. Further, embodiments of the present invention provide an electrical contact assembly that is configured to safely, securely, and evenly mate with a reciprocal or counterpart mating contact. For example, the locking member 40 ensures such safe, secure and even mating.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable other skilled in the art to utilize the invention. The claims are to be construed to include alternative embodiments to the extent permitted by the prior art.

Various features of the invention are set forth in the following claims.

The invention claimed is:

1. An electrical contact assembly comprising:

a main body configured to receive and retain a wire;

contact legs associated with said main body and configured to mate with a mating structure;

an interlocking member that limits spreading of said contact legs; and a first resilient beam connected to one of said contact legs and a first portion of said interlocking member, and a second resilient beam connected to another of said contact legs and a second portion of said interlocking member, wherein each of said first portion and said second portion of said interlocking member includes a top surface and a bottom surface, such that when said first portion of said interlocking member is interlocked with said second portion of said interlocking member, each of said top surfaces and said bottom surfaces of said first portion and said second portion of said interlocking member are, respectively, coplanar, wherein the interlocking member comprises a first finger separated from a second finger by a gap, wherein when said contact legs begin to spread span, said first finger abuts against said second finger, thereby removing said gap therebetween said hafting movement of said first and second fingers and said contact legs, wherein at least one of the first and second fingers is one of L-shaped and C-shaped.

2. The electrical contact assembly of claim 1, further comprising a lance member integrally connected to said contact legs, wherein said lance member forms a connection between said contact legs.

3. The electrical contact assembly of claim 1, wherein said main body, said contact legs, and said interlocking member are integrally formed as a unitary piece.

4. The electrical contact assembly of claim 1, wherein said contact legs have a first material temper, and said main body has a second material temper, wherein said first material temper is different from said second material temper.

5. An electrical contact assembly comprising:

a main body configured to receive and retain a wire;

first and second contact legs extending away from said main body, said first and second contact legs configured to mate with a mating structure;

a first resilient beam connected to said first contact leg;

a second resilient beam connected to said second contact leg; and an interlocking member comprising first and second fingers, wherein said first finger is connected to said first resilient beam, and said second finger is connected to said second resilient beam, and wherein each of said first finger and said second finger includes a top surface, a bottom surface, a front side and a back side, each of said front side and said back side extending between said associated top surface and bottom surface, such that when said first finger is interlocked with said second finger, said front side of said first finger faces toward said contact legs, said back side of said first finger and said front side of said second finger are adjacent to and face each other, and said back side of said second finger faces toward said main body, and such that said top surfaces and said bottom surfaces of said first finger and said second finger are arranged in a non-overlapping manner with respect to each other, wherein said first finger comprises a first finger beam integrally formed with a first ridges, and wherein said second finger comprises a second finger beams integrally formed with a second ridge, wherein said first ridge is separated from said second ridge by a gap when the electrical contact assembly is at rest, and wherein when said first and second contact legs begin to spread apart, said first ridge abut against at least one of said second ridge and said second finger beam, hereby hafting movement of said first and second fingers and said first and second contact legs, wherein at least one of the first and second fingers is one of L-shaped and C-shaped.

6. The electrical contact assembly of claim 5, wherein said interlocking member limits spreading of said first and second contact legs and maintains a normal force of said first and second contact legs.

7. The electrical contact assembly of claim 5, further comprising a lance member integrally connected to said contact legs, wherein said lance member forms a connection between said contact legs.

8. The electrical contact assembly of claim 5, wherein said main body, said first and second contact legs, said first and second resilient beams, and said interlocking member are integrally formed as a unitary piece.

9. The electrical contact assembly of claim 5, wherein said first and second contact legs have a first material temper, and said main body has a second material temper, wherein said first material temper is different from said second material temper.

10. An electrical contact assembly comprising:

a main body configured to receive and retain a wire;

first and second contact legs associated with said main body, said first and second contact legs configured to mate with a mating structure;

a connection beam integrally connected to said contact legs, wherein said connection beam forms a connection between said contact legs;

a first resilient beam connected to said first contact leg;

a second resilient beam connected to said second contact leg; and an interlocking member comprising first and second fingers, wherein said first finger is connected to said first resilient beam, and said second finger is connected to said second resilient beam, such that said first finger and said second finger are adapted to interlock with each other without having to fold over or further form any portion of said first and second fingers, and wherein said interlocking member limits spreading of said first and second contact legs, wherein said first finger comprises a first finger beam integrally formed with a first ridges, and wherein said second finger comprises a second finger beams integrally formed with a second ridge, wherein said first ridge is separated from said second ridge by a gap when the electrical contact assembly is at rest, and wherein when said first and second contact legs begin to spread apart, said first ridge abut against at least one of said second ridge and said second finger beam, hereby hafting movement of said first and second fingers and said first and second contact legs, wherein at least one of the first and second fingers is one of L-shaped and C-shaped.

11. The electrical contact assembly of claim 10, wherein said first and second contact legs have a first material temper, and said main body has a second material temper, wherein said first material temper is different from said second material temper.

* * * * *